US011454907B2

(12) United States Patent
Shibata et al.

(10) Patent No.: US 11,454,907 B2
(45) Date of Patent: Sep. 27, 2022

(54) CONTROL OF HEATING ELEMENTS FOR MEDIA CONDITIONERS

(71) Applicant: HEWLETT-PACKARD DEVELOPMENT COMPANY, L.P., Spring, TX (US)

(72) Inventors: Alan Shibata, Vancouver, WA (US); Matthew Raisanen, Vancouver, WA (US); Robert Yraceburu, Vancouver, WA (US); Richard Lee Brinkly, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/500,338

(22) PCT Filed: Jun. 27, 2018

(86) PCT No.: PCT/US2018/039844
§ 371 (c)(1),
(2) Date: Oct. 2, 2019

(87) PCT Pub. No.: WO2020/005239
PCT Pub. Date: Jan. 2, 2020

(65) Prior Publication Data
US 2021/0382422 A1 Dec. 9, 2021

(51) Int. Cl.
*G03G 15/20* (2006.01)
*B41J 11/00* (2006.01)
*B41J 2/14* (2006.01)

(52) U.S. Cl.
CPC ..... *G03G 15/2039* (2013.01); *B41J 11/0095* (2013.01); *B41J 11/00242* (2021.01); *B41J 2/14088* (2013.01); *G03G 15/2042* (2013.01)

(58) Field of Classification Search
CPC ..... G03G 15/2039; G03G 15/2042; B41J 11/00242; B41J 11/0095; B41J 2/14088
See application file for complete search history.

(56) References Cited

U.S. PATENT DOCUMENTS 4,719,489 A 1/1988 Ohkubo et al.
5,708,920 A 1/1998 Ohnishi et al.
6,118,955 A 9/2000 Yoneda et al.
6,853,831 B2 2/2005 Hirst et al.
(Continued)

FOREIGN PATENT DOCUMENTS

JP 2012247739 A 12/2012

*Primary Examiner* — Geoffrey S Mruk
(74) *Attorney, Agent, or Firm* — Conley Rose PC

(57) ABSTRACT

In some examples, a media conditioner includes a conveying component to convey a sheet of printable media, a heating element to heat the conveying component, a temperature sensor to measure a temperature of the conveying component, a media sensor to detect the sheet of printable media, and a controller to provide a power level to the heating element. A temperature set-point is set to a pre-established value. Based on data from the temperature sensor, the controller is to maintain the temperature of the conveying component at the temperature set-point by varying the power level. The controller is to apply a boost to the power level based on a signal from the media sensor while the temperature set-point remains at the pre-established value.

5 Claims, 4 Drawing Sheets

(56) References Cited

U.S. PATENT DOCUMENTS

| | | | | |
|---|---|---|---|---|
| 7,022,944 | B2 | 4/2006 | Yoshinaga et al. | |
| 8,909,075 | B2 | 12/2014 | Aoki | |
| 9,448,516 | B2 | 9/2016 | Ishigaya et al. | |
| 2003/0126962 | A1 | 7/2003 | Bland et al. | |
| 2008/0063419 | A1 | 3/2008 | Tateishi et al. | |
| 2009/0065492 | A1 | 3/2009 | Aritaki et al. | |
| 2010/0086324 | A1 | 4/2010 | Smith | |
| 2010/0329753 | A1* | 12/2010 | Pawlik ..... | G03G 15/2039 399/329 |
| 2012/0121303 | A1 | 5/2012 | Takagi et al. | |
| 2013/0209126 | A1* | 8/2013 | Seo ..... | G03G 15/2039 399/69 |

* cited by examiner

CONTROL OF HEATING ELEMENTS FOR MEDIA CONDITIONERS

BACKGROUND

Printing images or text on printable media in a printer includes various media processing activities, including pick-up, delivery to a print engine, printing, and conditioning of sheets of printable media. Conditioning involves heating and pressing the sheets through or past a heated conveying component, such as a heated pressure roller (HPR), to remove liquid (for printers using liquid ink), to remove wrinkles or curvature, or to reform or flatten fibers in the sheets.

BRIEF DESCRIPTION OF THE DRAWINGS

Various examples are described below referring to the following figures.

DETAILED DESCRIPTION

Figure 1:
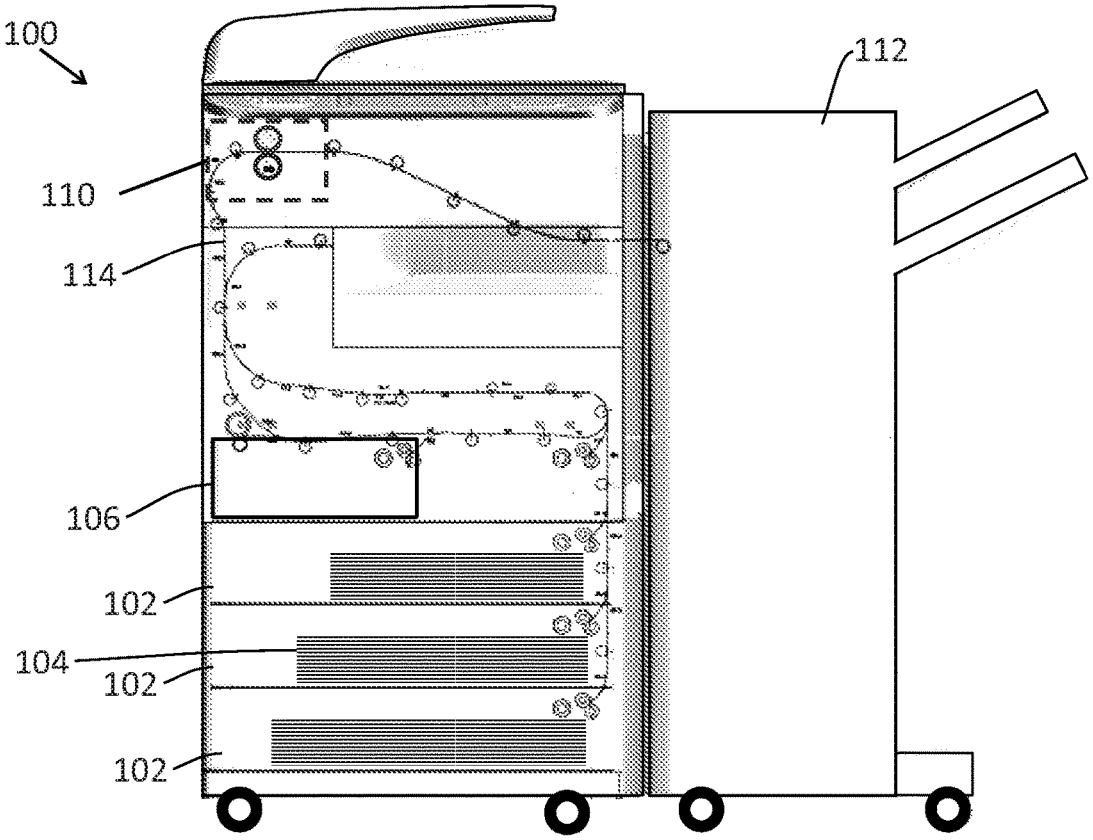
FIG. 1 shows a media printing system, which includes a media conditioner in accordance with various examples.

In the figures, certain features and components disclosed herein may be shown exaggerated in scale or in somewhat schematic form, and some details of certain elements may not be shown in the interest of clarity and conciseness. In some of the figures, in order to improve clarity and conciseness, a component or an aspect of a component may be omitted.

In the following discussion and in the claims, the terms "including" and "comprising" are used in an open-ended fashion, and thus should be interpreted to mean "including, but not limited to . . . ." Also, the term "couple" or "couples" is intended to be broad enough to encompass both indirect and direct connections. Thus, if a first device couples to a second device, that connection may be through a direct connection or through an indirect connection via other devices, components, and connections. In addition, as used herein, the terms "axial" and "axially" generally refer to positions along or parallel to a central or longitudinal axis (e.g., a central axis of a body or a port). As used herein, including in the claims, the word "or" is used in an inclusive manner. For example, "A or B" means any of the following: "A" alone, "B" alone, or both "A" and "B."

In an example, a media printing system includes a media conditioner coupled to a printer apparatus, which may also be called a print engine. The print engine is to form an image on a sheet of printable media by a technology such as inkjet, laser, or digital offset, as examples. The media conditioner is positioned to receive sequentially sheets of printed media from the printing device after images are formed on the sheets. The images may include text, figures, or photographic images and may be black, monochrome, or multicolor, as examples. In various examples, conditioning the media includes heating the media, removing an ink solvent, melting an ink, or increasing the flatness of the media. In various examples, the media printing system may also be called a printer, an all-in-one printer, or a photocopier.

In examples, the media conditioner includes a conveying component to receive, contact, heat, and convey the media. The first conveying component may be a belt. The media conditioner includes a heating element positioned to heat the belt, a temperature sensor to measure a temperature of the belt, a media sensor to detect sheets of printable media, and, a controller to control a power level provided to the heating element. As an example, the media sensor may be positioned upstream of the belt to detect the leading edge, the trailing edge, or both edges of a sheet of media. In the example, the media conditioner includes a second conveying component, which is a driven roller. The belt and the roller contact and press against each other along a nip area to receive, convey, and heat the media. During operation, rotational movement of the roller drives the belt to rotate. The controller includes a first functional control unit to maintain the temperature of the belt at a pre-established temperature set-point using temperature data from the temperature sensor, with or without paper between the roller and the belt. The first functional control unit may include a PID (proportional-integral-derivative) circuit or may be established by machine readable code that includes PID functionality, as examples.

During operation of a media conditioner, as a sheet of printable media contacts the belt and roller, heat is conductively transferred to the sheet. In general, this heat transfer potentially causes the temperature of the belt or roller to be reduced until the first functional control unit compensates by applying additional power to heat the belt. Variations in the temperature of the belt or roller can cause variations in the performance of the media conditioner. To maintain a more uniform temperature and more uniform performance, the media conditioners disclosed herein preemptively apply a discrete power increase or "boost" value, as it may be called, to a heating element for the belt or roller.

For the example media conditioner, as the media approaches the heated belt and the nip area, as indicated by a signal from the media sensor, the control system predictively applies a predetermined increase (boost) to the power level of the heating system based on various parameters, such as the type of media, (e.g., the thickness or material), the travel speed of the media, the ink density across the media, and environmental conditions, as examples. This discrete power boost is applied to the belt's heater prior to the arrival of the media to compensate for the extra heat load that is applied when the media contacts the belt. As examples, the boost to the power level may be a step-function that immediately applies the entire magnitude of the boost or may be a ramp function that applies the boost using a smooth change or using increments. The power boost is to assist with maintaining the heated belt temperature equal to the temperature set-point.

In some examples, as the trialing edge of the sheet of media is near to entering or near to leaving the nip area, which may be determined with the aid of the media sensor, the system applies a decrease to the power level of the heating system. These changes to the power level override what the controller's PID circuit or code has selected for the power level at the time that the changes are applied. However, the controller's temperature set-point remains unchanged from its pre-established value and the PID circuit or code continues to respond to measurements of belt temperature even after a power level increase is implemented and after a power level decrease is implemented. In various examples, the method and arrangement are to apply the boost and achieve the temperature set-point for the belt without changing the temperature set-point and without purposefully raising a temperature of a roller or belt that conveys and heats the media. In some of these examples, with respect to temperature control, the application of the increase or the decrease to the power level is an open-loop aspect of the controller's logic. In some examples, the controller includes a second functional control unit to apply the boost to the power level. The second functional control unit may operate independently of the first functional control unit. The second functional control unit may include a physical circuit or may be established by machine readable code, as examples. More examples of media conditioners for media printing systems and techniques of evaluating them are described below.

The example of FIG. 1 shows a media printing system 100 that includes multiple media trays 102 to hold multiple sheets of printable media 104, a print engine 106, a media conditioner 110, and a finisher 112. A media path 114 extends from media trays 102 to print engine 106, media conditioner 110, and finisher 112. In the separate media trays 102, the sheets of printable media may vary by face size, thickness, material, surface finish, color, etc.

Figure 2:
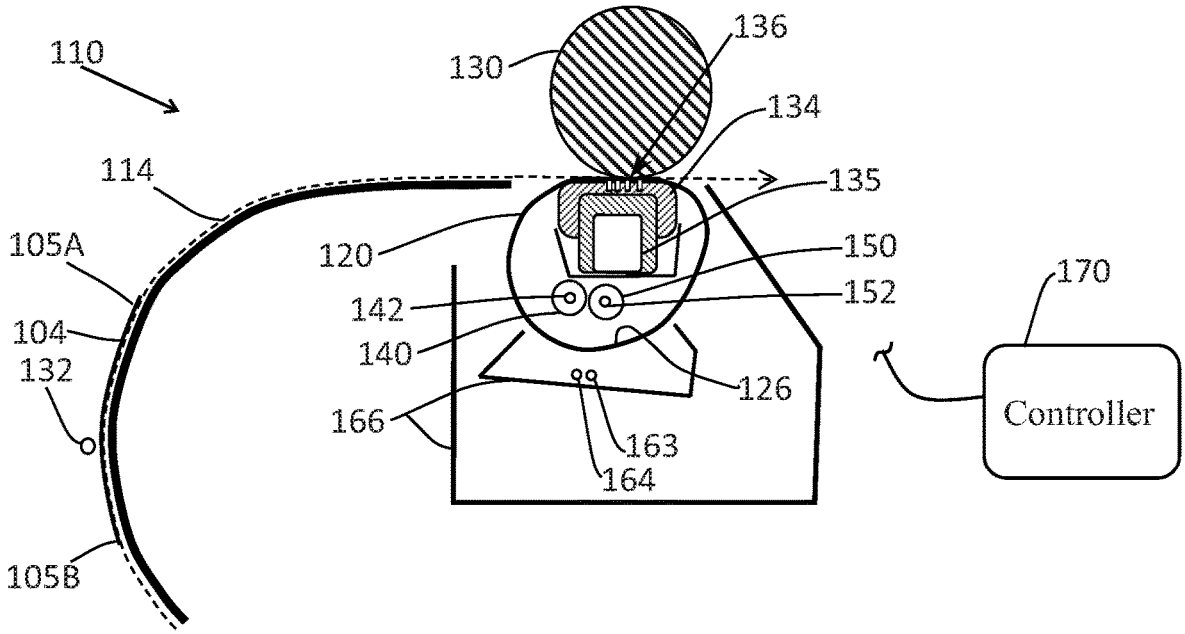
FIG. 2 shows a side view of the media conditioner of FIG. 1, which includes heat lamps, a heated belt, and a controller in accordance with various examples.

Referring now to FIG. 2, media conditioner 110 includes a first conveying component coupled to engage a second conveying component to receive, contact, heat, and convey a sheet of printable media 104. In this example, the first conveying component is a heated belt 120, and the second conveying component is a driven roller 130, which may be driven to rotate by a motor. Media conditioner 110 includes a media sensor 132 disposed along path 114, a platen 134 and a platen support structure 135 to support and guide the belt 120, a first and a second heater, which are heat lamps 140, 150, a first and a second temperature sensor 163, 164, a chassis 166, and a controller 170. In width, belt 120, roller 130, platen 134 and platen support structure 135 extend "into the page" of FIG. 2. Media sensor 132 is to sense and generate a signal in response to a sheet of printable media being proximal the sensor (e.g., detecting the sheet). The media may be moving or stationary. In FIG. 2, a sheet 104 is located on media path 114 within the sensing range of sensor 132. Sheet 104 includes a leading edge 105A and trailing edge 105B, named based on the intended direction of travel of sheet 104. The leading edge 105A is located beyond sensor 132, and trailing edge 105B has not yet reached sensor 132. Sensor 132 may detect the leading edge 105A, the trailing edge 105B, or the body of the sheet of media between edges 105A, 105B.

Lamps 140, 150 are radiant heaters. First heat lamp 140 includes a first heating element 142, and second heat lamp 150 includes a second heating element 152. Lamps 140, 150 extend within belt 120 to heat a heating zone 126 of the belt by thermal radiation. Heating zone 126 includes the portions of belt 120 that are in the field of view of lamps 140, 150 at any given moment in time. In various examples, the heating elements 142, 152 may be designed and arranged to heat different portions of belt 120. Temperature sensors 163, 164 may measure temperatures on these different portions of belt 120 separately to facilitate control of heating elements 142, 152 by controller 170. In some examples, both heating elements 142, 152 may be designed and arranged to heat the entire width of the belt, or a single heating element may be utilized. During operation, roller 130 is conductively heated by contact with belt 120, and a length or a piece of media, when present, is to be heated by contact with belt 120 and roller 130. In some examples, heating elements 142, 152 may be disposed outside belt 120. Lamps 140, 150 may be halogen-type lamps, but other types of lamps or other types of heating elements may be used to heat belt 120 or roller 130.

Still referring to FIG. 2, belt 120 and roller 130 contact and press against each other along a nip region 136 to receive and convey the media. Nip region 136 extends along the shared width of belt 120 and roller 130. During operation, rotational movement of the roller 130 drives the belt 120 to rotate by friction or by gearing, with or without media, in between the roller 130 and the belt 120. First and second temperature sensors 163, 164 are non-contacting thermistors located outside and below belt 120. Sensors may be disposed at different locations along the width of belt 120. Other examples may include another form of non-contact temperature sensor or may include a contact temperature sensor located in an appropriate position.

Figure 3:
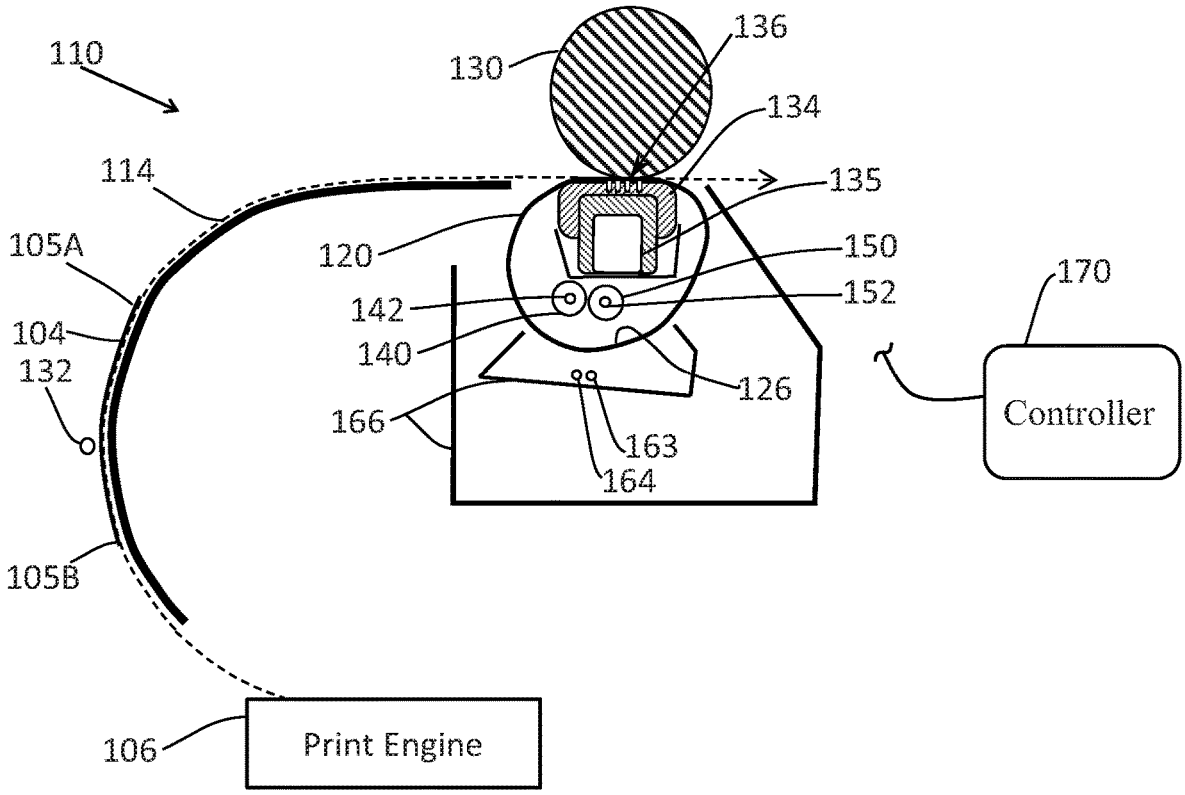
FIG. 3 shows a side view of a media printing system having a media conditioner and a print engine like those of FIG. 1 and FIG. 2.

FIG. 3 is similar to FIG. 2 in structure and function, except that print engine 106 is expressly shown.

Some examples of a media conditioner 110 include temperature sensors to measure the temperatures at locations along the width of the second conveying component, for example roller 130. Some examples of a media conditioner may include a conveying component, such as belt 120 or roller 130 that is conductively heated by a heater.

Figure 4:
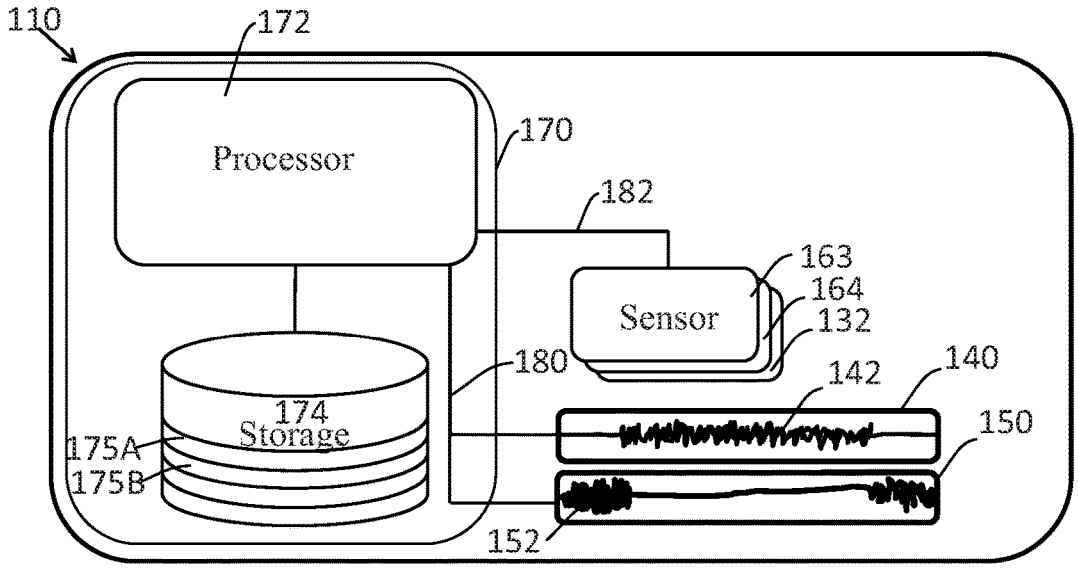
FIG. 4 shows a schematic view of the media conditioner of FIG. 2 in accordance with various examples.

As shown in FIG. 4, controller 170 includes a processor 172, storage 174, electrical couplings 180 for heat lamps 140, 150, and electrical couplings 182 for sensors 132, 163, 164. In various examples, controller 170 may be assigned to govern the operation of media printing system 100 as a whole or may be assigned to govern media conditioner 110 alone, being coupled to communicate with another controller of media printing system 100. In some examples, controller 170 shares components, such as storage 174, with another controller of media printing system 100.

Storage 174 is a computer-readable medium holding machine executable code to be executed by processor 172. Machine executable code may also be called machine readable instructions or computer executable code. The machine executable code stored in storage 174 includes code 175A and code 175B. Code 175A, when executed by controller 170, causes controller 170 (e.g., its processor 172) to provide a first power level to first lamp 140 and its heating element 142 and to provide a second power level to second lamp 150 and its heating element 152 so that the first and second heating elements 142, 152 generate heat to heat the belt 120. In addition, code 175A is to cause controller 170 to monitor signals or data from temperature sensors 163, 164 to vary the power levels supplied to heating elements 142, 152 and to maintain the temperature of belt 120 at a desired temperature set-point. The temperature set-point is set to a pre-established value appropriate for achieving a desired heat transfer behavior in media conditioner 110 to condition media that passes through it. In some examples, different temperature set-points are applied to heating elements 142, 152 and compliance is separately monitored using temperature data from sensors 163, 164. As used herein, a "temperature set-point" will refer to a set-point for either heating element 142, 152 or for both heating elements 142, 152. In some examples, code 175A establishes a first functional unit within processor 172 to perform the tasks described for code 175A. The first functional unit may include PID functionality or behavior.

The first and second power levels are variable. During operation, controller 170 is to provide separate first and second power level signals to control heating elements 142, 152, respectively. In an example, the power level signals are pulse-width-modulated (PWM) signals. Whether controller 170 uses a PWM signal, another analog power level signal, or a digital power level signal, the signal may vary incrementally or smoothly from zero to 100%. The value of 100% power refers to the maximum power that the heating element can accept or the maximum power that the system can provide. Broadly, the term "power level" will refer to electrical power that is to be made available to a heating element or that is used by a heating element, or it will refer to the power level signal for controlling the electrical power to a heating element. Although electrical couplings 180 are simply shown as a direct connection between controller 170 and heating lamps 140, 150, in various examples, electrical couplings 180 connect the controller 170 to a power supply that feeds heating lamps 140, 150.

Referring still to FIG. 4, when executed by controller 170, machine executable code 175B in storage 174 causes controller 170 (e.g., its processor 172) to monitor the movement of printable media through media conditioner 110 and to apply a power boost to a power level for a heating element 142, 152. In some examples, executable code 175B, when executed, causes controller 170 to apply a preemptive decrease to a power level for a heating element 142, 152 based on movement of printable media through media conditioner 110. In some examples, code 175B establishes a second functional control unit within processor 172 to perform the tasks described for code 175B, and the second functional control unit operates independently of the first functional control unit. In various examples, the power boost is a step-function or a ramp function, such as a linear PWM ramp. In some examples, the power boost is between 10 and 20% of the magnitude of the current power level set by controller 170 using code 175A. In some examples, the power boost is between 1 and 50% of the magnitude of the current power level set by controller 170 using code 175A. In some of these examples, the power boost is a fixed value.

During operation, when controller 170 executes code 175A, 175B in parallel, a check-and-balance system is established for the power boost. The second functional control unit applies a power boost proactively to avoid a drop in the temperature of belt 120 while the first functional control unit guards against the belt overshooting the temperature set-point. If belt temperature, as measured by a sensor 163, 164, begins to rise beyond the temperature set-point after a power boost is applied, the first functional control unit can reduce the power.

Figure 5A:
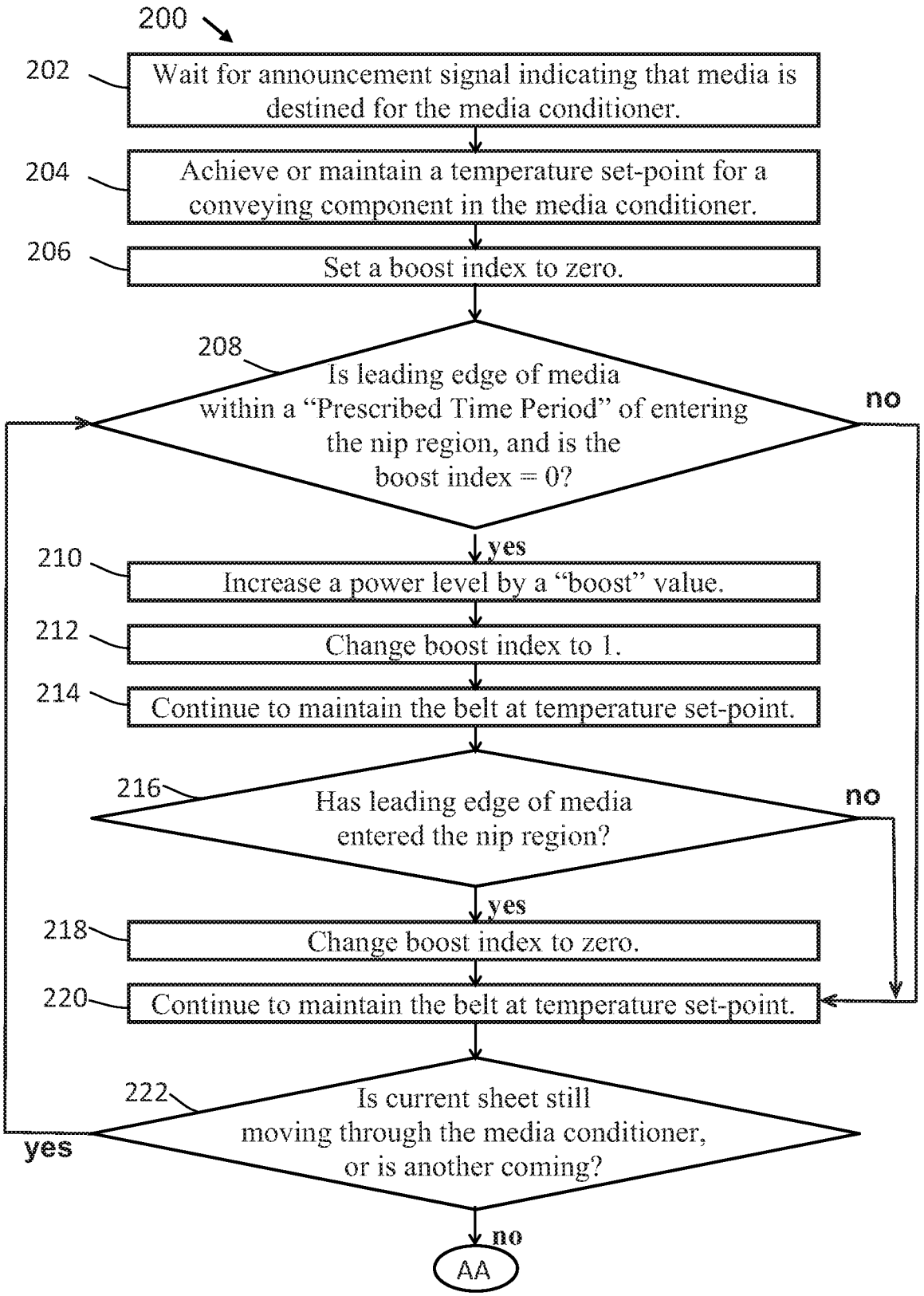
FIGS. 5A & 5B shows a flow chart of a method of operating the media conditioner of FIG. 2 in accordance with various examples.
Figure 5B:
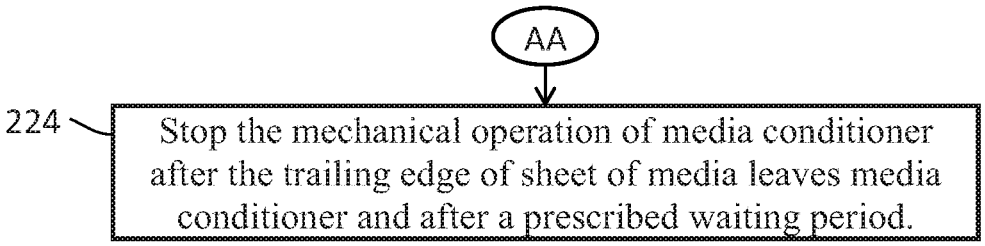

Referring now to the flow chart of FIGS. 5A & 5B, an example is depicted of a method or process 200 for operating controller 170 to govern various aspects of the operation of media conditioner 110 and its heating elements 142, 152 using code 175A and code 175B. In process 200, at block 202, controller 170 is to wait for an announcement signal that media is destined for the media conditioner 110. The announcement signal may come from print engine 106, media sensor 132, or another component of system 100. When the announcement signal is received, machine readable code 175A is activated at block 204 to command media conditioner 110 to achieve and maintain the temperature set-point for belt 120 by generating or sending power levels for heating elements 142, 152 based on temperature readings from sensors 163, 164. The power level may include, for example, a PWM signal, or another type of power level, such as those that are mentioned above. At block 206, controller 170 is to set a boost index to zero. The boost index is a status reminder that controller 170 maintains. At block 208, controller 170 is to evaluate the location of an approaching sheet of media to determine whether its leading edge is within a prescribed time period of entering the nip region 136 of belt 120 and roller 130 (FIG. 2). For block 208, controller 170 looks for a signal from media sensor 132 indicating that the leading edge of a sheet of media has reached sensor 132 and calculates how far the leading edge has traveled along media path 114 after sensor 132 activated its signal. The prescribed time period may be established based on various parameters including the travel speed of the media, thermal properties of belt 120, the response time of heating elements 142, 152 to add heat to belt 120, and the travel time of the belt between its heating zone 126 and nip region 136, as examples. The travel speed of the media may be a predetermined value for system 100. In effect, block 208 includes predicting an arrival time to indicate when the leading edge of the sheet is anticipated to reach a conveying component.

Also at block 208, controller 170 is to determine whether the boost index is equal to zero. If both conditions (sheet location and index value) are true, the process continues along the "yes" path to block 210. In some examples, block 208 produces a true result and continues to block 210 for a situation in which the leading edge has reached nip region 136 prior to controller 170 having commanded a boost to the power level. If one of the two conditions in block 208 is false ("no"), the process jumps to block 220.

Continuing to reference FIG. 5A, as controller 170 reaches block 210 in the process, code 175A of controller 170 continues to generate or send power levels for heating elements 142, 152 based on temperature readings from sensors 163, 164 and the temperature set-point. At block 210, controller 170 is to increase the power level to first heating element 142 or to second heating element 152 by a power boost. The value of this boost is to be added to the current value of the power level that has been set by code 175A. This activity may include boosting the power levels to both heating elements 142, 152. At block 212, the boost index is set equal to 1, indicating that a power boost has been applied due to the presence of the media. At block 214, code 175A of controller 170 continues to generate or send power levels for heating elements 142, 152 based on temperature readings from sensors 163, 164 to maintain belt 120 at the temperature set-point.

At block 216, controller 170 is to evaluate the location of the leading edge of the sheet of media to determine whether it has entered the nip region 136. Controller 170 may make the determination based on the signal from media sensor 132 and the travel speed of the media along media path 114. If the result is true ("yes") (e.g., the leading edge has entered the nip region), then the process continues to block 218 in which the boost index is set to zero, and the process proceeds to block 220. If the result from block 216 is false ("no"), the process jumps to block 220, bypassing block 218. At block 220, code 175A of controller 170 continues to generate or send power levels for heating elements 142, 152 based on temperature readings from sensors 163, 164 to maintain belt 120 at the temperature set-point.

Still referring to FIG. 5A, at block 222, controller 170 is to evaluate the location of the sheet of media to determine whether it is still moving towards or through media conditioner 110 or whether another sheet is coming. Controller 170 may make the determination based on the signal from media sensor 132 and the travel speed of the media along media path 114. The signal from media sensor 132 is to change when a trailing edge of the sheet of media passes by the media sensor. If the result is true ("yes") (e.g., the same sheet is moving towards or passing through the media conditioner, or another sheet is moving towards the media conditioner), then the process returns to block 208. If the result from block 222 is false ("no") (e.g., no more media is approaching media sensor 110 or the media conditioner along path 114), the process continues to block 224 in FIG. 5B, as indicated by connector "AA." In block 224, controller 170 stops or deactivates the mechanical operation of media conditioner 110 following a prescribed waiting period after the trailing edge of a sheet of media leaves media conditioner. The waiting period may be a predetermined length of time, which may be, for example, on the order of seconds or milliseconds. Following block 224, controller 170 may return to block 202. In some examples of process 200, the blocks 202-222 are performed repeatedly before executing block 224, and block 224 is executed after controller 170 receives a shut-down signal for media conditioner 110.

In this example, code 175A includes blocks 204, 214, 220, 224 and code 175B includes blocks 206, 208, 210, 212, 216, 218, 222. In this example, code 175A executes concurrently with code 175B. Although blocks 204, 214, 220 appear as discrete events in FIGS. 5A & 5B, in this and some other examples, controller 170 may perform the tasks of blocks 204, 214, 220 concurrently with various blocks associated with code 175B. Code 175B may execute without interaction or without data exchange from code 175A. In some examples, code 175B may interact with code 175A during execution regarding values established for the power level.

In process 200 of FIGS. 5A & 5B, controller 170 is to apply the boost to the power level based on a signal from the media sensor 132 without the boost altering the temperature set-point. In some examples of the operation of process 200, the temperature set-point remains at the pre-established value while the boost is applied. In various implementations of block 208 and block 210, controller 170 is to apply the boost to a power level before the leading edge of the media reaches a conveying component, e.g., belt 120 or roller 130.

In some examples of process 200, controller 170 is to monitor when the trailing edge of the sheet of media (a) has passed the media sensor 132 (e.g., sensor 132 no longer detects the sheet of media), (b) is approaching the nip region, or (c) has entered the nip region 136. When one of these conditions is true, controller 170 is to apply a discrete decrease to the power level in response. As examples, the power decrease may be a step-function that immediately applies the entire magnitude of the decrease or may be a ramp function that applies the power decrease using a smooth change or using increments. In some of these examples, the decrease to the power level is applied before the trailing edge reaches belt 120, roller 130, or nip region 136. When implemented, this decrease in power level is performed by the controller in response to executing code 175B. In some examples, this decrease in power level may be described as being preemptive because it predicts and prepares for an imminent or future reduction in heat load for belt 120 due to departure of printable media rather than waiting for code 175A to respond to a temperature change in belt 120 that may occur after the media departs.

When media conditioner 110 is to process multiple sheets of media in sequence, controller 170 applies a first power boost based on code 175B before the first sheet arrives. When the sequential sheets arrive at nip 136 with a relatively short time-spacing or time-gap between the trailing edge of a sheet and the leading edge of the next sheet, the heat load experienced by belt 120 may be steady, and controller 170 may apply the first boost without a boost for some subsequent sheets. After the first boost, code 175A operating in controller 170 maintains the temperature of belt 120 at the temperature set-point, within an acceptable range of variation. In another scenario, the time-spacing between sequential sheets arriving at nip 136 may be longer, and controller 170 may apply a second power boost prior to the second sheet, a third power boost prior the third sheet, or may apply a power boost prior to each sheet of media, as examples.

In some examples, the time-spacing between sequential sheets arriving at nip region 136 is relatively short being less than 100 milliseconds (ms) and greater or equal to 25 ms. In some examples, the time-spacing between sequential sheets is less than 25 ms. In some instances, the time-spacing between sequential sheets is longer, being between 100 ms and 1 second, for example. In some examples, the time-spacing between sequential sheets is greater than 1 second. In some examples, when the time-spacing between sequential sheets arriving at nip region 136 is less than 100 milliseconds (ms), controller 170 applies a power boost once, before the first sheet arrives, treating the sheets as a continuous group. In various examples, when the time-spacing between a current and a subsequent sheet is greater than 100 milliseconds (ms), controller 170 applies a power boost prior to the arrival of the subsequent sheet at nip region 136, treating the sheets individually. A longer time-spacing between sheets increases the potential for code 175A to reduce the power level for a heating element 142, 152 between sheets, which would make repeated power boosts beneficial. In some other examples, the decision by controller 170 and code 175B to treat sequential sheets as either a continuous group or as individual sheets in regard to the power boost may be differentiated by a time-spacing that is greater than or is less than 100 ms.

Figure 6:
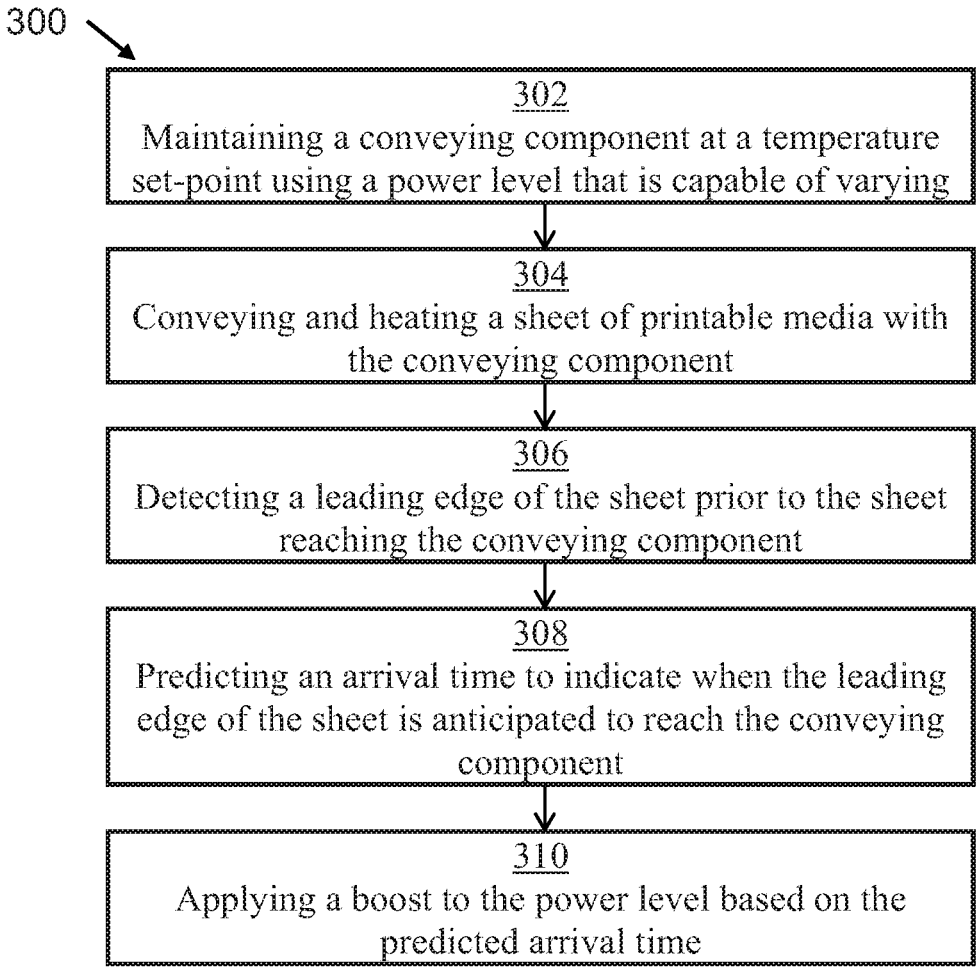
FIG. 6 shows a flow diagram of a method of operating the media conditioner of FIG. 2 in accordance with various examples.

FIG. 6 presents an example of a method 300 for controlling a temperature in a media conditioner and for applying a boost to the power level for a heating element of the media conditioner. Method 300 may be implemented in media conditioner 110 of FIG. 2, as an example. Continuing with FIG. 6, block 302 of method 300 includes maintaining a conveying component at a temperature set-point using a power level that is capable of varying. Heated belt 120 is an example of the conveying component. Block 304 includes conveying and heating a sheet of printable media with the conveying component. Block 306 includes detecting a leading edge of the sheet prior to the sheet reaching the conveying component. Block 308 includes predicting an arrival time to indicate when the leading edge of the sheet is anticipated to reach the conveying component, and block 310 includes applying a boost to the power level based on the predicted arrival time. In some implementations of method 300, maintaining the conveying component at the temperature set-point continues during and after application of the boost.

Some implementations of method 300 include detecting a trailing edge of the sheet prior to the sheet reaching the conveying component, predicting a second arrival time to indicate when the trailing edge is anticipated to reach the conveying component, and applying a decrease to the power level based on the second prediction. In various examples, this decrease is independent of temperature measurements, such as temperature measurements from sensors 163, 164, for example. Some implementations of method 300 may incorporate other functionalities disclosed herein. In some implementations of method 300, maintaining the conveying component at the temperature set-point continues during and after conveying and heating the sheet, and applying the decrease to the power level occurs before the trailing edge of the sheet reaches the conveying component. Some implementations of method 300 include forming an image on the sheet prior to conveying and heating the sheet, and applying the boost to the power level occurs before the leading edge of the sheet reaches the conveying component. Forming an image on the sheet may be accomplished by print engine 106 (FIG. 1), for example.

In some examples, a method for controlling a temperature in a media conditioner and for applying a boost to the power level for a heating element includes temporarily pausing a temperature set-point control functionality while applying a boost to a power level for the heating element. This pause may result in a period of time in which control of the heating element that is entirely open-loop with respect to temperature of the conveying component, lacking feedback from a temperature sensor.

The above discussion is meant to be illustrative of the principles and various examples of the present disclosure. Numerous variations and modifications will become apparent to those skilled in the art. It is intended that the following claims be interpreted to embrace all such variations and modifications.

What is claimed is:

1. A media conditioner comprising:

a conveying component to convey sheets of printable media;

a heating element to heat the conveying component;

a temperature sensor to measure a temperature of the conveying component;

a media sensor to detect the sheets of printable media; and a controller to provide a power level to the heating element, wherein, based on temperature data from the temperature sensor, the controller is to maintain the temperature of the conveying component at a temperature set-point by varying the power level, wherein the temperature set-point is set to a pre-established value, and wherein the controller is to selectively control power level based on a time-spacing between sequential sheets in the sheets of printed media as detected using the media sensor, without altering the temperature set-point.

2. The media conditioner of claim 1 wherein the sheet of printable media includes a leading edge and a trailing edge, and wherein the controller is to apply a boost to the power level before the leading edge reaches the conveying component.

3. The media conditioner of claim 2 wherein the controller is to apply a decrease to the power level in response to the media sensor no longer detecting the sheet or before the trailing edge reaches the conveying component.

4. The media conditioner of claim 2 wherein the controller is to continue to maintain the temperature of the conveying component at the temperature set-point while the controller applies the boost.

5. The media conditioner of claim 1 wherein the power level includes a pulse-width-modulated (PWM) signal, and wherein the boost includes a linear PWM ramp.

* * * * *